US008991516B2

(12) United States Patent
Wei

(10) Patent No.: US 8,991,516 B2
(45) Date of Patent: Mar. 31, 2015

(54) ELECTRIC TOOL

(75) Inventor: Gan Wei, Nanjing (CN)

(73) Assignee: Chervon (HK) Limited, Hong Kong (HK)

( * ) Notice: Subject to any disclaimer, the term of this patent is extended or adjusted under 35 U.S.C. 154(b) by 865 days.

(21) Appl. No.: 13/197,862

(22) Filed: Aug. 4, 2011

(65) Prior Publication Data

US 2012/0037387 A1 Feb. 16, 2012

(30) Foreign Application Priority Data

Aug. 10, 2010 (CN) ..... 2010 1 0253482

(51) Int. Cl.

| | |
|---|---|
| ***B25D 5/00*** | (2006.01) |
| ***B25F 5/02*** | (2006.01) |
| ***B25D 11/06*** | (2006.01) |
| ***B25D 17/26*** | (2006.01) |

(52) U.S. Cl.

CPC ..... *B25F 5/02* (2013.01); *B25D 11/068* (2013.01); *B25D 17/26* (2013.01); *B25D 2211/003* (2013.01); *B25D 2211/006* (2013.01); *B25D 2250/005* (2013.01); *B25D 2250/365* (2013.01)

USPC ..... 173/122; 173/39; 173/38; 173/49; 173/51

(58) Field of Classification Search

CPC ..... B25D 2216/0076; B25D 2217/0096; B25D 11/068; B25D 11/04; B25D 17/26; B25D 2211/003; B25D 2211/006; B25D 2250/005; B25D 2250/121; B25D 2250/365

USPC ..... 173/90, 91, 216, 217, 170, 185, 171, 173/46, 106, 200, 201, 39, 38, 49, 51, 122; 227/147

See application file for complete search history.

(56) References Cited

U.S. PATENT DOCUMENTS

| | | | | |
|---|---|---|---|---|
| 3,067,584 | A * | 12/1962 | Atkinson | 92/84 |
| 3,127,941 | A * | 4/1964 | Sieber | 173/98 |
| 3,269,466 | A * | 8/1966 | Mitchell | 173/93.6 |
| 4,432,446 | A * | 2/1984 | Okano et al. | 192/84.961 |
| 4,462,467 | A * | 7/1984 | Weingartner | 173/105 |
| 4,483,574 | A * | 11/1984 | Chabrerie et al. | 439/5 |
| 5,193,281 | A * | 3/1993 | Kasten | 30/394 |
| 5,346,023 | A * | 9/1994 | Takagi et al. | 173/178 |
| 5,832,611 | A * | 11/1998 | Schmitz | 30/392 |
| 5,940,977 | A * | 8/1999 | Moores, Jr. | 30/392 |
| 6,058,815 | A * | 5/2000 | Habermehl | 81/434 |
| 6,138,364 | A * | 10/2000 | Schmitz | 30/392 |
| 6,457,535 | B1 * | 10/2002 | Tanaka | 173/48 |
| 6,478,095 | B2 * | 11/2002 | Neumaier | 173/48 |
| 6,494,590 | B1 * | 12/2002 | Paganini et al. | 362/119 |
| 6,715,765 | B2 * | 4/2004 | Machida | 277/409 |
| 6,838,627 | B1 * | 1/2005 | Isberg et al. | 200/262 |
| 7,108,395 | B2 * | 9/2006 | Correa | 362/191 |
| 7,172,342 | B2 * | 2/2007 | Oda et al. | 384/488 |

(Continued)

*Primary Examiner* — Hemant M Desai
*Assistant Examiner* — Eduardo R Ferrero
(74) *Attorney, Agent, or Firm* — Greenberg Traurig, LLP

(57) ABSTRACT

An electric tool includes a gripping portion, a working portion rotatably connected to the gripping portion about an axis, an output shaft moving in a reciprocating manner and accommodated in the working portion, and a gear box accommodated in the gripping portion for driving the output shaft. The gear box has an opening so that the output shaft is moveable from one end to the other end of the opening when the working portion is rotated relative to the gripping portion about the axis. A leakage-preventing device, such as a bushing, is arranged at the opening so that the lubricating grease can be avoided from leaking.

9 Claims, 8 Drawing Sheets

(56) References Cited

U.S. PATENT DOCUMENTS

| | | | | |
|---|---|---|---|---|
| 7,204,026 | B2 * | 4/2007 | Phillips et al. | 30/394 |
| 7,303,026 | B2 * | 12/2007 | Frauhammer et al. | 173/48 |
| 7,306,049 | B2 * | 12/2007 | Soika et al. | 173/49 |
| 7,325,624 | B2 * | 2/2008 | Yamazaki | 173/48 |
| 7,506,447 | B2 * | 3/2009 | Wheeler et al. | 30/392 |
| 7,779,931 | B2 * | 8/2010 | Townsan | 173/216 |
| 7,926,585 | B2 * | 4/2011 | Pozgay et al. | 173/39 |
| 8,047,302 | B2 * | 11/2011 | Berger et al. | 173/1 |
| 8,261,850 | B2 * | 9/2012 | Fuchs | 173/117 |
| 8,297,373 | B2 * | 10/2012 | Elger et al. | 173/94 |
| 2002/0129936 | A1 * | 9/2002 | Cernosek | 166/264 |
| 2004/0188953 | A1 * | 9/2004 | Fonville et al. | 277/603 |
| 2005/0005458 | A1 * | 1/2005 | Marinkovich et al. | 30/394 |
| 2005/0034881 | A1 * | 2/2005 | Berger et al. | 173/2 |
| 2005/0044729 | A1 * | 3/2005 | Tachibana et al. | 30/393 |
| 2005/0196634 | A1 * | 9/2005 | Abe et al. | 428/615 |
| 2006/0096768 | A1 * | 5/2006 | Ookubo | 173/48 |
| 2007/0289759 | A1 * | 12/2007 | Hartmann et al. | 173/48 |
| 2008/0283260 | A1 * | 11/2008 | Kramer et al. | 173/128 |
| 2009/0020299 | A1 * | 1/2009 | Manschitz et al. | 173/49 |
| 2009/0122550 | A1 * | 5/2009 | Gordin et al. | 362/285 |
| 2009/0178905 | A1 * | 7/2009 | Lewin et al. | 200/270 |
| 2009/0277657 | A1 * | 11/2009 | Berger et al. | 173/114 |
| 2009/0314506 | A1 * | 12/2009 | Meixner | 173/49 |
| 2010/0089601 | A1 * | 4/2010 | Fukinuki et al. | 173/20 |
| 2010/0326689 | A1 * | 12/2010 | Meixner | 173/122 |
| 2011/0000693 | A1 * | 1/2011 | Fuchs | 173/117 |
| 2011/0000770 | A1 * | 1/2011 | Jansson et al. | 200/252 |
| 2011/0030983 | A1 * | 2/2011 | Kakiuchi et al. | 173/46 |
| 2011/0094763 | A1 * | 4/2011 | Wei | 173/46 |
| 2011/0100663 | A1 * | 5/2011 | Wu | 173/122 |
| 2011/0108298 | A1 * | 5/2011 | Zhou | 173/122 |
| 2011/0108299 | A1 * | 5/2011 | Wei | 173/122 |
| 2011/0114348 | A1 * | 5/2011 | Braun | 173/109 |
| 2011/0155402 | A1 * | 6/2011 | Abe et al. | 173/48 |
| 2011/0203824 | A1 * | 8/2011 | Elger et al. | 173/205 |
| 2012/0037387 | A1 * | 2/2012 | Wei | 173/46 |

* cited by examiner

ELECTRIC TOOL

RELATED APPLICATION DATA

This application claims the benefit of CN 201010253482.3, filed on Aug. 8, 2010, the disclosure of which is incorporated herein by reference in its entirety.

BACKGROUND

The subject disclosure generally relates electric tools and, more particularly, to a leakage-preventing and sealing device for the grease lubricating the moveable members inside an electric tool.

In electric tools, most of the moveable members need to be lubricated by grease. The lubricating effect of the grease is, however, often diminished with use of the electric tool. This is particularly true for electric tools having high-speed-rotating moveable members. Moreover, if the grease leaks out to an electrical connection part, the electric connection quality could be affected.

SUMMARY

To solve the above-mentioned problems, the following describes an electric tool equipped with a leakage-preventing device.

More particularly, described hereinafter is an electric tool having a gripping portion, a working portion rotatably connected to the gripping portion about an axis, a gear box accommodated within the gripping portion and having an opening, and an output shaft movably accommodated within the working portion in a reciprocating manner with the output shaft being rotated and displaced from one end to the other end of the opening along with the working portion. A leakage-preventing device is arranged at the opening.

In a described embodiment, the leakage-preventing device comprises a bushing rotatably arranged within the gear box, and the bushing is provided with a hole through which the output shaft may pass. Generally, the hole extends along the axis direction of the output shaft.

Further, the bushing may be provided with a notch and a grease-gathering portion, shaped as a barb, may be arranged at a first end or/and a second end of the notch where it protrudes to the inside of the bushing.

Still further, a transmission gear may be contained in the gear box and the transmission gear is provided with a groove within which the first end and/or the second end of the notch can be engaged.

Yet further, impact components may also be contained in the gear box and an isolating rib portion, for avoiding grease leaking, may be arranged between the transmission gear and the impact components.

Yet further, the working portion may be provided with a light source with a scraping device being arranged on an electric connection device of the light source.

Yet further, the electric connection device may comprise a moveable connecting piece arranged on the working portion and a stationary connecting piece connected with the moveable connecting piece and disposed on the gripping portion with the scraping device having scraping pieces disposed on the two sides of the moveable connecting piece respectively and with one end of a scraping piece contacting with the stationary connecting piece.

Yet further, the scraping device may include grease-gathering grooves disposed on two ends of the stationary connecting piece.

By adopting one or more of the above mentioned technical solutions, the following technical effects can be obtained:

1) with the bushing disposed at the opening of the gear box for avoiding grease leaking, the opening of the gear box can be covered no matter how the bushing is displaced along with the output shaft, so that leaking of the lubricating grease can be avoided;

2) the isolating rib portion disposed between the transmission gear and the impact components can decrease the flowing diffusion of the lubricating grease from the transmission area to the striking area; and 3) if the connecting piece of the light source is adhered with the leaked lubricating grease, the scraping piece can scrape away the leaked lubricating grease to ensure the unobstructed contact between the connecting pieces and the grease-gathering grooves disposed on the ends of the scraping piece respectively along the rotation direction thereof can be used for gathering the scraped grease.

BRIEF DESCRIPTION OF THE DRAWINGS

An electric tool will be further explained hereinafter with reference to the accompanying drawings, wherein.

DETAIL DESCRIPTION

A preferred embodiment of an electric tool will be explained in detail hereinafter wherein the electric tool is embodied in an electric hammer for striking a nail. It is to be understood, however, that this illustrative embodiment is not intended to be limiting. Rather, those of skill in the art will readily understand how to utilize the various components described hereinafter in other electrical devices to achieve the same results.

As shown in FIGS. 1-6, an electric hammer comprises a gripping portion 20 having a first axis A and a working portion 10 having a second axis B, the working portion 10 being rotatable with respect to the gripping portion 20 about a third axis C which is perpendicular to a plane defined by the first axis A and the second axis B. The intersection between the second axis B and the first axis A is closer to the tip end of the gripping portion 20 than the intersection between the third axis C and the first axis A, so that the working portion 10 can be operated in a narrower space.

Figure 1:
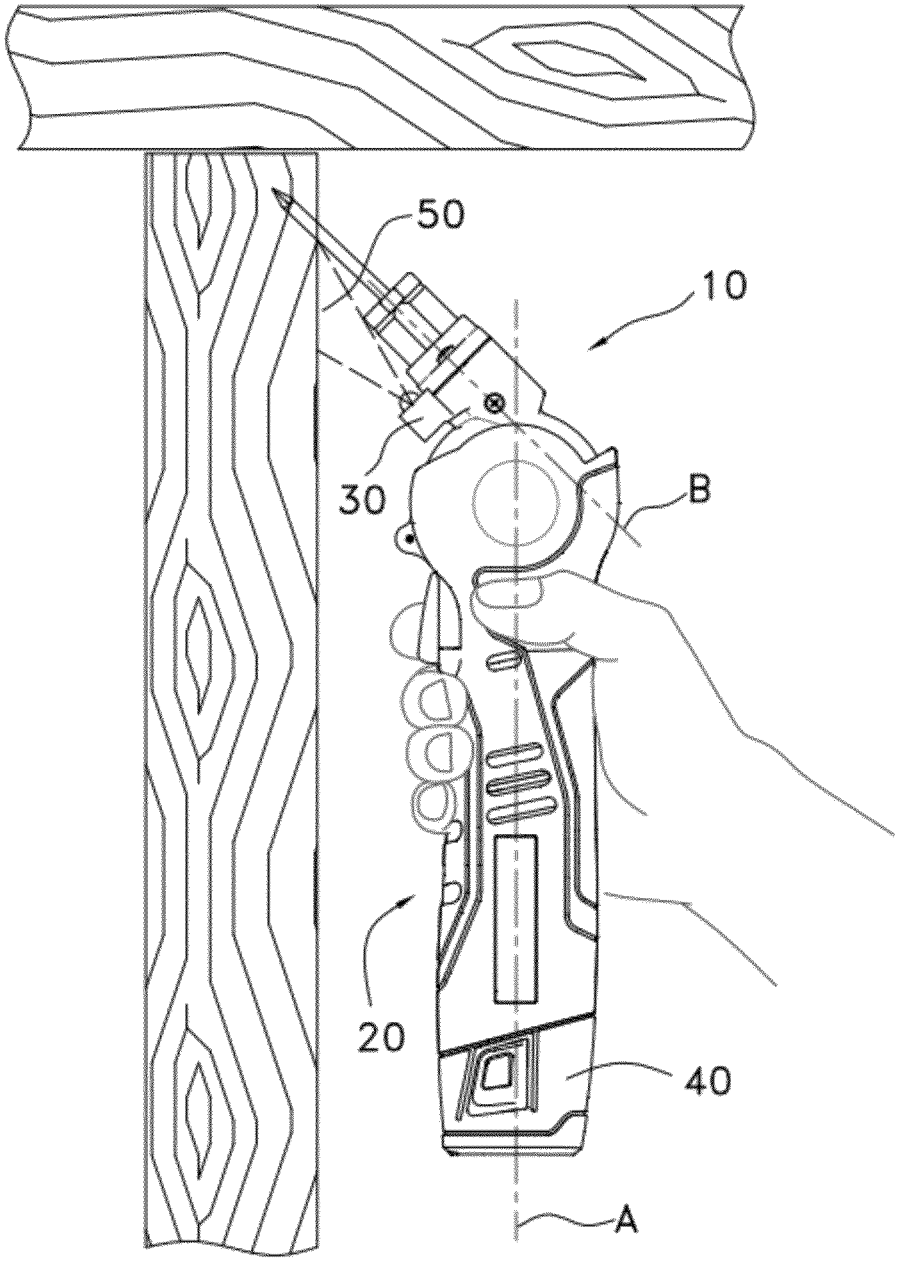
FIG. 1 is a schematic view of an exemplary electric tool constructed according to the description that follows showing an operating state for striking a nail.
Figure 2:
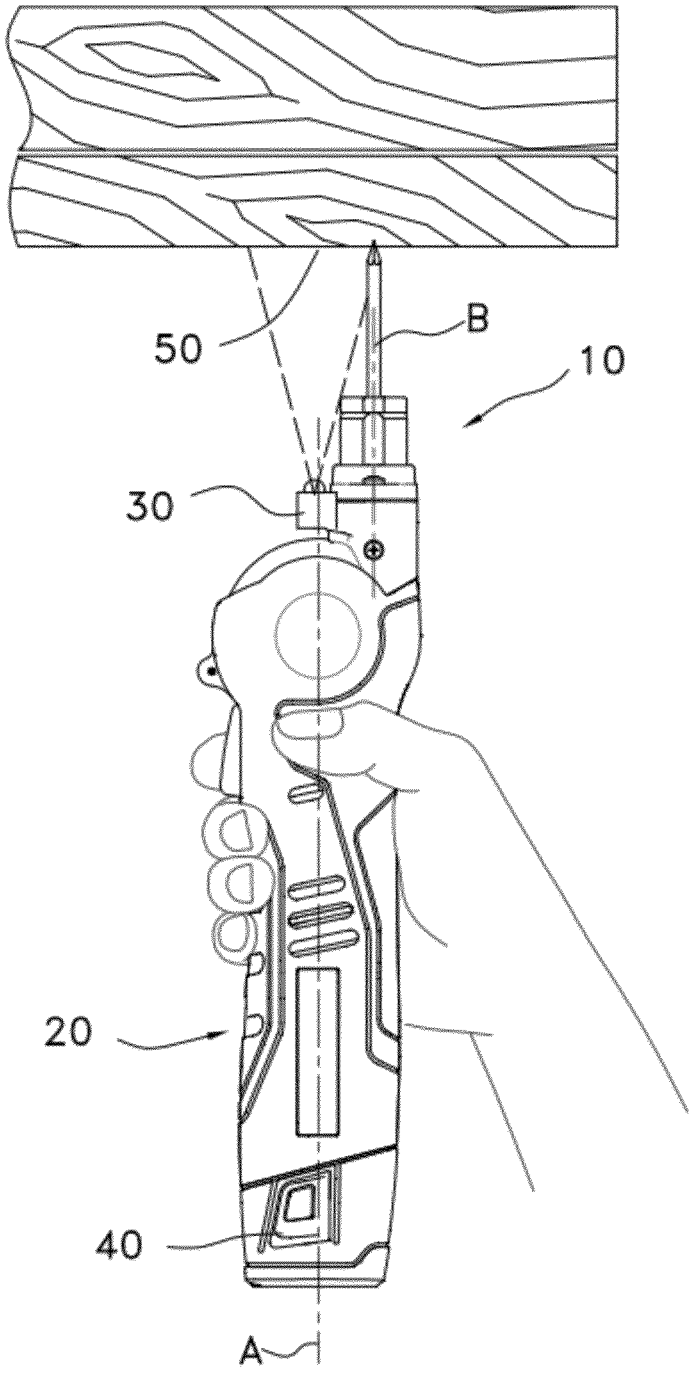
FIG. 2 is a schematic view of the electric tool showing another operating state for striking a nail.
Figure 3:
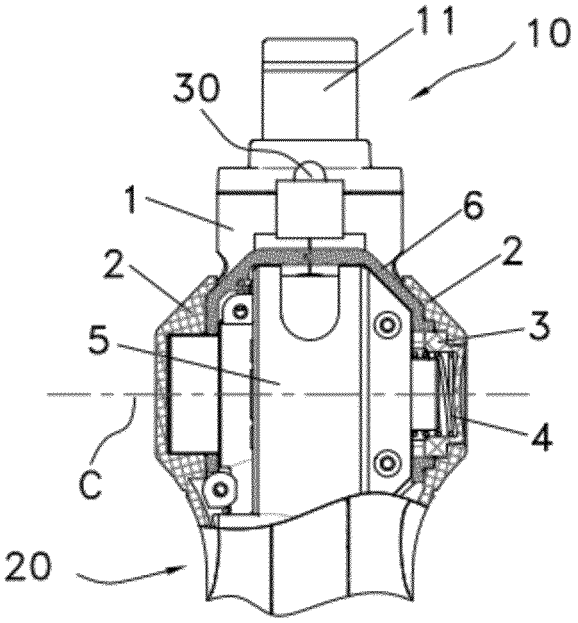
FIG. 3 is a partial sectional view seen from the front of the electric tool.

As shown in FIG. 1, when the electric hammer is operated at a corner area formed by two workpieces that are disposed perpendicular to each other, the nail is struck into one workpiece at an angle of 45 degrees relative to the surface of the other workpiece so as to connect the two workpieces. In this case, the working portion 10 is rotated by 135 degrees relative to the gripping portion 20 and the hand of the operator grips the upright gripping portion, so that it is labor-saving and comfortable for operation. To enhance the light brightness in the working area 50 during striking of a nail, a light source 30 may be further disposed on the rotatable working portion 10. As shown in FIG. 2, when one workpiece at the top needs to be operated upon, it is unnecessary for the operator to adjust the orientation of the gripping portion 20 manually but, instead, the operator need only rotate the working portion 10 to a position that is 180 degrees relative to the gripping portion 20, so that the operation of the device remains convenient.

As shown in FIGS. 3-6, the working portion 10 has positioned therein working parts 1 which mainly comprises an output shaft 7 for striking a nail, a bushing 6 exteriorly mounted on the output shaft 7, a cover 12 and a nail-receiving opening 11, etc. The gripping portion 20 comprises a housing 2 for supporting a gear box 5 and the working parts 1. A transmission gear 9 and impact components 8 are supported within the gear box 5. A releasing button 3 is further provided on the housing 2 for locking and releasing the working parts 1, which can be restored by a biasing member 4.

The operation principle of rotation is that: the releasing button 3 has a discontinuous surface on the periphery thereof, accordingly, the housing 2 and the working parts 1 also have discontinuous surfaces for mating with that of the releasing button 3. When the releasing button 3 is located between the housing 2 and the working parts 1, the working parts 1 are locked and can not be rotated. When the releasing button 3 is pressed, the discontinuous surface of the releasing button 3 disengages from the housing 2 and entirely enters into the working parts 1, so that the working parts 1 can be rotated. Due to the biasing member 4, the releasing button 3 has a tendency of disengaging from the working parts 1 and entering into the housing 2. When the releasing button 3 is rotated by a certain angle, the discontinuous surface thereof is consistent with the discontinuous surface on the housing 2, as a result, the releasing button 3 enters into the housing and the working parts 1 is locked.

When the working parts 1 rotate, the output shaft 7 mounted thereon is substantially tangential at its axle center to the peripheral circle of the rotating impact components 8.

Figure 4:
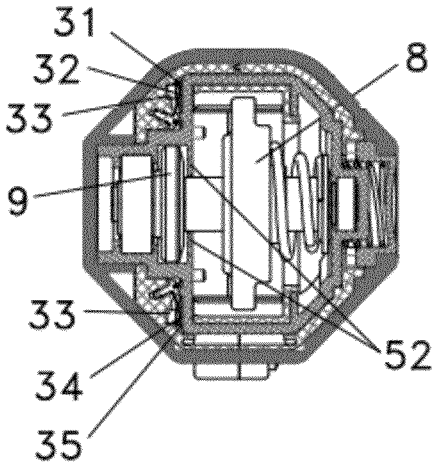
FIG. 4 is a sectional view taken along the axis C shown in FIG. 3.
Figure 7:
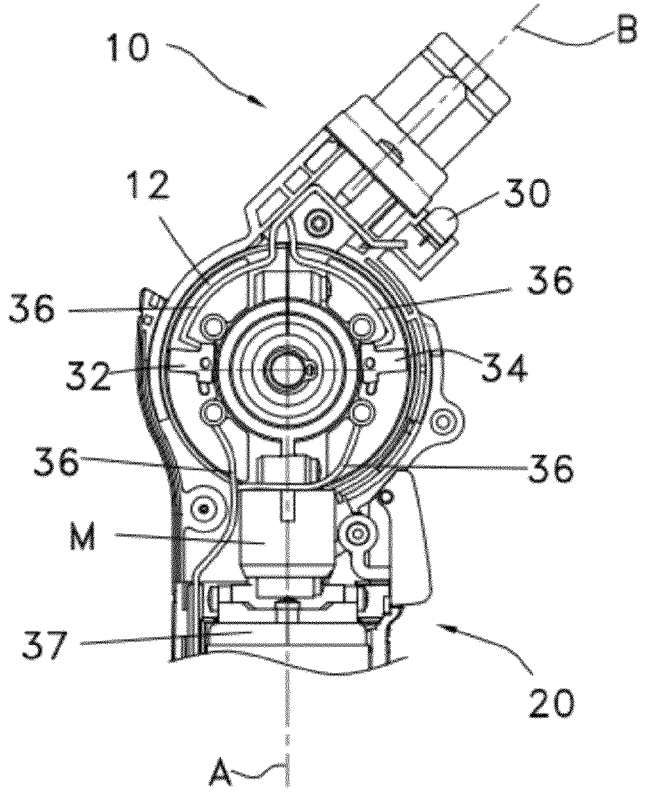
FIG. 7 is a schematic view illustrating an exemplary electric connection of a light source on the electric tool.

As shown in FIGS. 4 and 7, the connection mode of the light source 30 (preferably, a LED light) is schematically shown. For the convenience of the user after rotating the working parts 1, the LED light is configured to be rotated along with the working parts 1. The LED is mounted on the working parts 1 so that the light emitted therefrom can illuminate the working area 50 in front of the nail-receiving opening 11. The wiring takes the form of: the positive and negative wires are led out from the LED at one end thereof and soldered onto the moveable positive and negative connecting pieces 34, 32 at the other end thereof, respectively. The wires are arranged along the inside surface of the cover 12 in the form of an arc. The moveable positive and negative connecting pieces 34, 32 are fixed on the cover 12 respectively, and the stationary positive and negative connecting pieces 35, 31 are fixed on the front and rear sides of the gear box 5 respectively. When the cover 12 is mounted on the gear box 5, the moveable positive and negative connecting pieces 34, 32 contact with the stationary positive and negative connecting pieces 35, 31, respectively. Another two positive and negative wires 36 are connected to the stationary positive and negative connecting pieces 35, 31 at one end thereof and to the PCB assembly at the other end thereof, respectively. The stationary positive and negative connecting pieces 35, 31 are longer in length than the movable positive and negative connecting pieces 34, 32, so that the moveable positive and negative connecting pieces 34, 32 can slide on the positive and negative static connecting pieces 35, 31 when the working portion 10 rotates relative to the gripping portion.

To ensure a reliable connection between the connecting pieces, an elastic member 33 is disposed on the moveable positive and negative connecting pieces 34, 32 respectively for assisting them into contact with the stationary positive and negative connecting pieces 35, 31.

Referring to FIGS. 1 and 2, it is preferred to dispose the light source 30 at the lower portion of the working portion 10. The light source 30 is controlled by a switch controlling the motor M and is supplied with power from a battery package 40 disposed at the bottom portion of the gripping portion 20.

Figure 5:
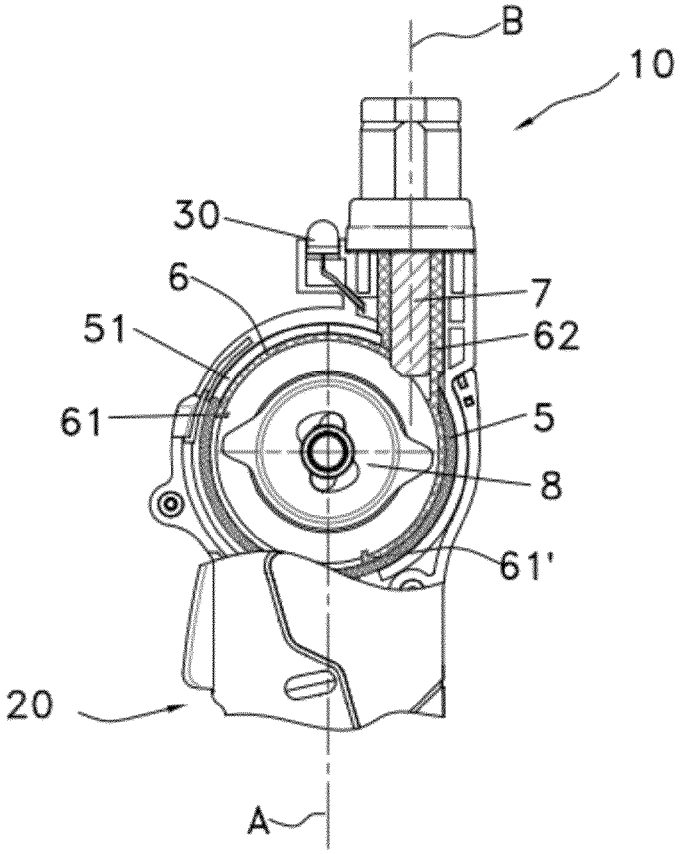
FIG. 5 is a partial sectional view seen from the side of the electric tool showing a working portion being rotated 180 degrees with respect to a gripping portion.
Figure 6:
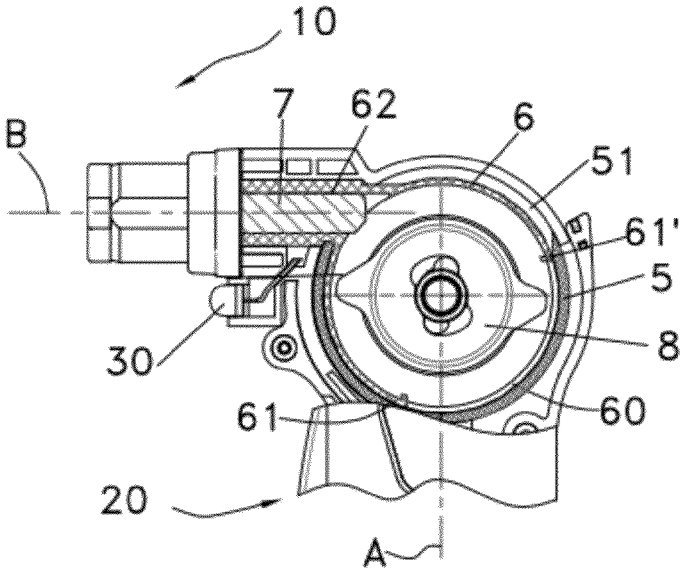
FIG. 6 is a partial sectional view seen from the side of the electric tool showing the working portion being rotated 90 degrees with respect to the gripping portion.
Figure 9:
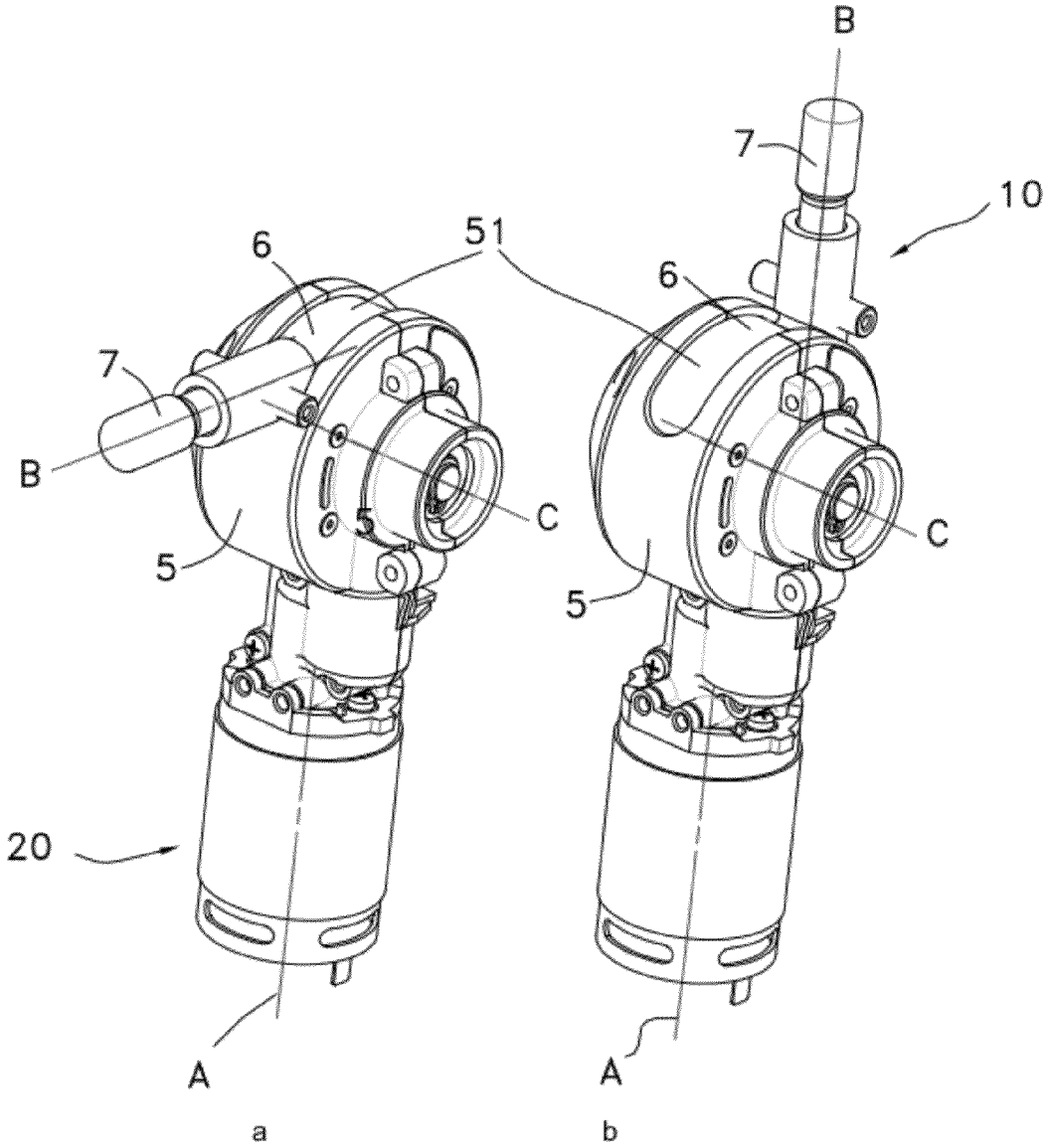
FIG. 9 is a schematic view illustrating an exemplary leakage-preventing device disposed on the electric tool wherein the leakage-preventing device comprises a bushing disposed at the opening of a gear box, and an output shaft is connected to the inside of the axle hole provided on the bushing and drives the bushing to move from a first end position (a) to a second end position (b) of the gear box opening.

In the illustrated embodiment, to prevent the lubricating grease inside the device from leaking out due to the motion of the members, a leakage-preventing device for controlling the grease is provided in the electric tool. As shown in FIGS. 9, 5 and 6, the gear box 5 has an opening 51, hence, when the impact components 8 in the gear box 5 are driven to rotate in the gear box 5 by the transmission gear 9, two tabs formed on the periphery of the impact components intermittently strike the output shaft 7 protruding to the inside of the opening 51 on the gear box. As a result, the output shaft 7 can move in a straight reciprocating manner within the working portion 10 to strike the nails or the like. In addition, since the working portion 10 of the electric hammer in this embodiment can be rotated relative to the gripping portion 20 to drive the output shaft 7 disposed therein to change its position, the opening 51 of the gear box serves to provide a space for the displacement of the output shaft 7.

To avoid the leakage of the lubricating grease in the gear box 5 from the opening 51, the bushing 6 is disposed at the opening 51 of the gear box. The profiles of the bushing 6 and the gear box 5 are concentric circles, wherein the bushing is encompassed by the gear box 5. The output shaft 7 is connected to the bushing 6 through the axle hole 62 formed on the bushing so that the bushing 6 can be driven to rotate along the inner surface of the gear box 5. As a result, the bushing 6 can move between the first end position (a) and the second end position (b) of the opening 51 on the gear box. It is noted that, the bushing 6 can cover the opening 51 on the gear box 5 no matter how it rotates, so that the leakage of the lubricating grease can be avoided.

Figure 10:
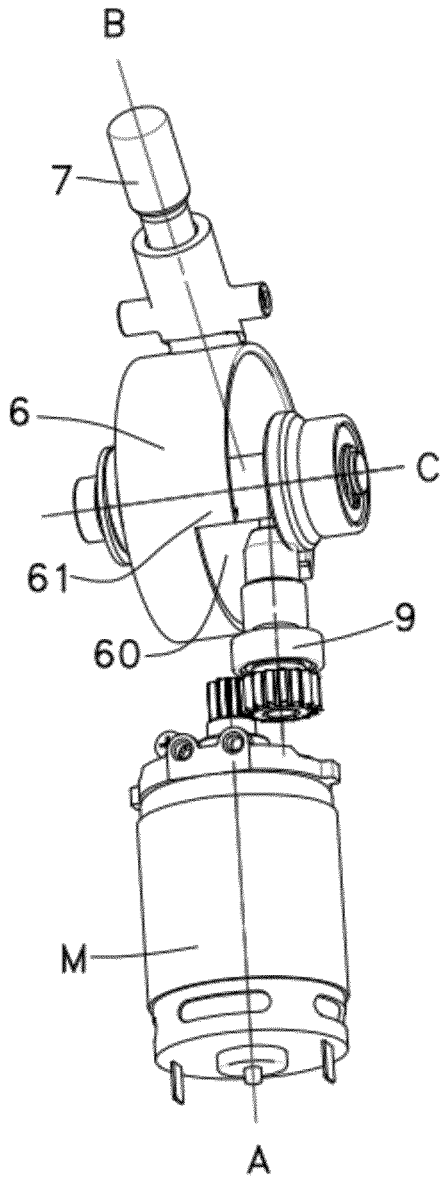
FIG. 10 is a schematic view illustrating a further technical feature of the leakage-preventing device in FIG. 9 wherein a notch is provided on the bushing for keeping the device away from the gear transmission position of a transmission gear.
Figure 11:
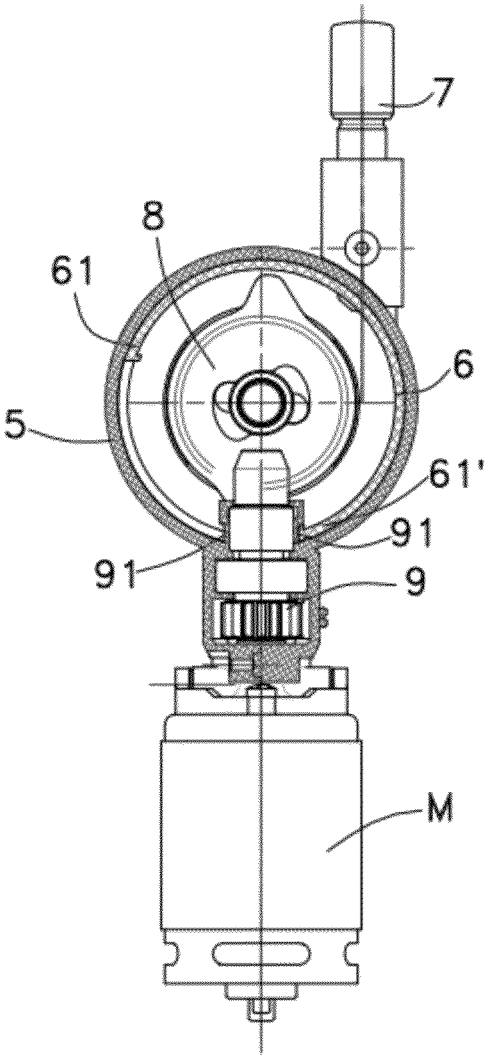
FIG. 11 is a schematic view illustrating a still further technical feature of the leakage-preventing device in FIG. 9 wherein a groove is provided at the gear transmission position.

As shown in FIG. 10, since the bushing 6 may interfere with the transmission gear 9 protruding into the gear box 5, in order to keep away from the gear transmission position of the transmission gear, a notch 60 is formed on the bushing 6, which has a first end 61 and a second end 61 separated from each other. To enhance the sealing effect for grease, it is preferred for the above leakage-preventing device to provide a barb-shaped grease-gathering portion on the first end 61 and/or the second end 61 of the bushing protruding to the inside of the bushing 6. In order to make the length of the bushing 6 overlapping with respect to the inner surface of the gear box at one end of the opening 51 on the gear box when the bushing 6 is rotated to the other end, it is preferred for the above leakage-preventing device to form a groove 91 at the gear transmission position where the two ends of the notch 60 on the bushing 6 may be touched, and one end of the notch 60 on the bushing 6 can be embedded into the groove 91 as illustrated in FIG. 11.

Since the outer surface of the bushing 6 is engaged with the inner surface of the gear box 5, the grease coming off the impact components 8 to the inner surface of the bushing 6 will flow back to the gear box 5 along this inner surface and is not likely to flow out of the gear box along the engagement surface. Certainly, it may be easily conceivable for those skilled in the art that the outer diameter of the bushing 6 may be slightly larger than the inner diameter of the gear box 5 so as to enhance the leak tightness of the seal. Referring to FIG. 4, another embodiment of the leakage-preventing device can be seen. Rib portions 52 are arranged on the gear box 5 for isolating the transmission gear 9 from the impact components 8, so that the flowing diffusion of the lubricating grease from the transmission area to the striking area can be reduced.

Figure 8:
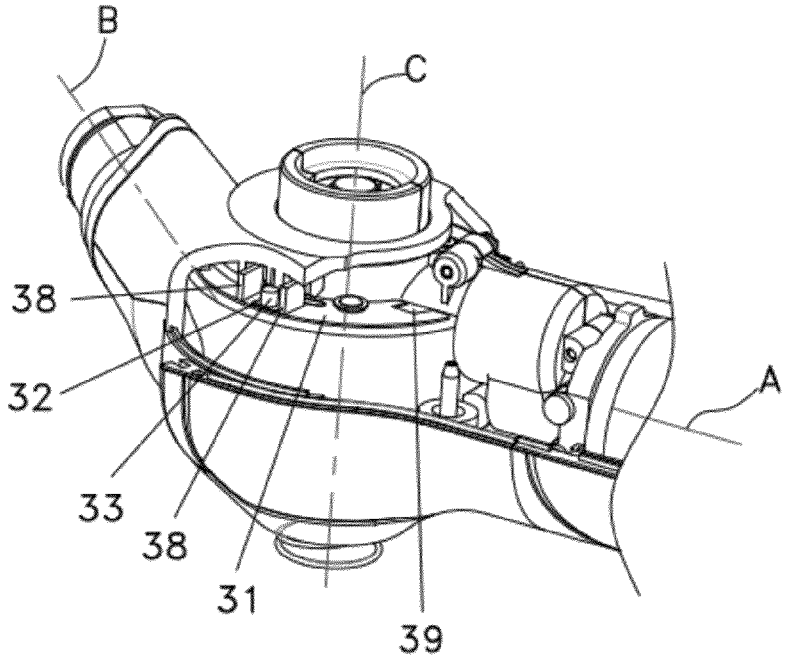
FIG. 8 is a schematic view illustrating an exemplary oil scraping device disposed on the device for electrically connecting with the light source.

To avoid a failure of connection of the LED due to the leakage of the grease, in the present embodiment a scraping device is disposed on the positive and negative connecting pieces of the circuit respectively. Referring to FIG. 8 and taken the scraping device disposed on the negative connecting piece for example, a scraping piece 38 is disposed on two sides of the moveable negative connecting piece 32 along the rotation direction thereof respectively, with one end of each scraping piece 38 being mounted on the cover 12 and the other end thereof being contacted by the stationary negative connecting piece 31. When the working parts 1 rotates and the stationary negative connecting piece 31 is adhered with the leaked lubricating grease, the scraping piece 38 can scrape away the grease immediately to ensure the unobstructed contact between the LED connecting pieces. Moreover, a grease-gathering groove may be formed on the ends of the scraping piece 38 along the rotating direction respectively for gathering the scraped grease. The scraping device disposed on the positive connecting piece is the same as the scraping device on the negative connecting piece.

While various concepts have been described in detail, it will be appreciated by those skilled in the art that modifications and alternatives to those concepts could be developed in light of the overall teachings of the disclosure. Therefore, it will be appreciated that the particular concepts disclosed are meant to be illustrative only and not limiting as to the scope of the invention which is to be given the full breadth of the appended claims and any equivalents thereof.

What is claimed is:

1. An electric tool, comprising:

a gripping portion;

a working portion rotatably connected to the gripping portion about an axis;

an output shaft moving in a reciprocating manner in a direction perpendicular to the direction of said axis and accommodated in the working portion;

a gear box accommodated in the gripping portion for driving the output shaft, the gear box having an opening so that the output shaft is moveable from one end to the other end of the opening when the working portion is rotated relative to the gripping portion about the axis; and a leakage-preventing device arranged at the opening of the gear box, the leakage-preventing device comprising a bushing rotatably mounted within the gear box about the axis, the bushing being formed with a hole in a direction perpendicular to the direction of said axis for the output shaft to pass therethrough and being arranged for always enclosing the opening of the gear box when the bushing is rotated between a first position and a second position.

2. The electric tool according to claim 1, wherein the hole in the bushing extends along the axis direction of the output shaft.

3. The electric tool according to claim 1, wherein the bushing has a notch and an inwardly projecting barb-shaped grease-gathering portion is arranged on at least one of a first end and a second end of the notch.

4. The electric tool according to claim 3, wherein a transmission gear is contained in the gear box, the transmission gear being provided with a groove engagable with the at least one of the first end and the second end of the notch.

5. The electric tool according to claim 1, wherein impact components are contained in the gear box and an isolating rib portion, is arranged between a transmission gear and the impact components for avoiding grease leaking.

6. The electric tool according to claim 1, wherein the working portion is provided with a light source and a scraping device is arranged on an electric connection device associated with the light source.

7. The electric tool according to claim 6, wherein the electric connection device comprises a moveable connecting piece arranged on the working portion and a stationary connecting piece connected with the moveable connecting piece and disposed on the gripping portion, the scraping device comprising scraping pieces formed on the moveable connecting piece and stationary connecting piece respectively wherein ends thereof are arranged to contact.

8. The electric tool according to claim 7, wherein the scraping device further comprises grease-gathering grooves disposed on an end of the stationary connecting piece.

9. The electric tool according to claim 1, wherein the bushing and the gear box are concentric circles.

* * * * *